US005195897A

United States Patent [19]

Kent et al.

[11] Patent Number: 5,195,897

[45] Date of Patent: Mar. 23, 1993

[54] CONNECTOR AND OPENING ACCESSORY

[75] Inventors: Harold B. Kent, Portola Valley; Gary Yasumura, Santa Clara, both of Calif.

[73] Assignee: Beta Phase, Inc., Menlo Park, Calif.

[21] Appl. No.: 880,496

[22] Filed: May 8, 1992

[51] Int. Cl.[5] ..... H01R 9/09

[52] U.S. Cl. ..... 439/67; 439/267; 439/484; 439/493

[58] Field of Search ..... 439/65, 67, 74, 77, 439/493, 495, 496, 484, 260, 267

[56] References Cited

U.S. PATENT DOCUMENTS 3,492,538 1/1970 Fergusson ..... 439/67
3,602,870 8/1971 Willard ..... 439/74
4,934,942 6/1990 Casciotti ..... 439/67
5,044,980 9/1991 Krumme et al. ..... 439/496
5,102,342 4/1992 Marian ..... 439/65

*Primary Examiner*—Neil Abrams
*Attorney, Agent, or Firm*—Burns, Doane, Swecker & Mathis

[57] ABSTRACT

An electrical connector, bridge connector and opening accessory to protect the contacts on flexible circuitry of such connectors from being damaged by the sharp edges of a printed circuit board like member wherein the opening accessory is provided with spaced apart cam means that spread apart cam bearing portions of the connectors outside flexible circuitry mounted thereon is disclosed.

19 Claims, 4 Drawing Sheets

CONNECTOR AND OPENING ACCESSORY

BACKGROUND OF THE INVENTION

1. Field of the Invention

The invention relates to high density high signal integrity electrical connectors and specifically to connectors that are specially suited for repetitive coupling and uncoupling with the edges of a printed circuit board or the like.

2. Prior Art

Interconnection of electronic devices such as integrated circuits and printed circuit boards or the like is complicated by the potential for wear and/or damage to a connector through mating and de-mating of a connector to the edge of a printed circuit board or the like. Commonly assigned U.S. Pat. No. 5,044,980 discloses a high density, multiple insertion connector that minimizes the amount of friction created by coupling and uncoupling of a connector wherein a generally hourglass-shaped insertion member isolates sliding contact between the components to surfaces of low frictional resistance material during the majority of the insertion and removal movements. Such a device, however, requires use of low frictional resistance material along the entire width of the male and female components of the connector and requires separate means for registration alignment of the components.

It would be highly desirable to provide a connector including an opening accessory that could be attached to the edge of a printed circuit board or the like that would interact with only portions of a connector to open and allow controlled and aligned closing of the connector about a printed circuit board or the like without wear and/or damage to the electrical conductors on either the connector or the printed circuit board or the like.

SUMMARY OF THE INVENTION

The purpose of the invention is to protect the contacts on flexible circuitry or the like of a connector from being damaged by the sharp edges of a component such as a printed circuit board like member that mates with the connector. To accomplish this purpose there is provided a connector assembly, a connector, a bridge connector and an opening accessory which is attachable to the edge of a mating component such as a printed circuit board like member, the opening accessory having at least two cam means at spaced positions along the edge of such a printed circuit board like member, the cam means each having associated camming surfaces to open and close a connector that is to be mated and de-mated from the printed circuit board like member.

In one aspect of the invention there is provided an opening accessory for a connector comprising: a base member adapted to be secured to the edge of a printed circuit board like member, said base member being elongated and having opposite ends; at least one set of first and second cam means connected to said base member, said first cam means positioned at one end of said base member and said second cam means positioned at the other end of said base member exposing portions of a printed circuit board like member between said first and second cam means, each said cam means having first and second camming surfaces to spread open a connector upon mating and de-mating to a printed circuit board like member; and at least one alignment means connected to said base member to position end portions of a connector to be mated to a printed circuit board like member.

In another aspect of the invention there is provided a connector assembly comprising: a connector having a biasing member, said biasing member being elongated with opposite ends having a longitudinal opening along the length thereof, said biasing member being generally C-shaped and having a center portion and arm portions having ends; flexible circuitry having generally parallel-spaced electrical conductors, at least a portion of said flexible circuitry mounted about said biasing member leaving cam bearing portions adjacent the opposite ends of said biasing member, said electrical conductors terminating in at least one set of electrical contacts, said set of contacts being positioned on at least one side of said opening; and an opening accessory having a base member, said base member being elongated and adapted to be connected to the edge of a printed circuit board like member to be mated, said opening accessory including first and second cam means positioned at opposite ends of said base member, each said cam means having first and second camming surfaces, said opening accessory including alignment means to position the cam bearing portions of said biasing member.

In yet another aspect of the invention there is provided a connecter assembly comprising: first and second connectors having first and second biasing members, respectively, said biasing members each being elongated and having opposite ends and a longitudinal opening along the length thereof, said biasing members being generally C-shaped and each having a center portion and arm portions having ends; first and second flexible circuitry, each circuitry having sets of generally parallel-spaced electrical conductors, said electrical conductors terminating in first and second sets of electrical contacts, respectively, said first flexible circuitry positioned about said first and second biasing members leaving cam bearing portions adjacent the opposite ends of each said biasing member, the first set of contacts of said first flexible circuitry being positioned within the center portion of said first biasing member and the second set of contacts of said first flexible circuitry being positioned within the opening of said second biasing member; said first set of electrical contacts of said second flexible circuitry being positioned within the center portion of said first biasing member on an arm portion opposite said first set of contacts of said first flexible circuitry and said second set of contacts of said second flexible circuitry being positioned in the center portion of said second biasing member on an arm portion opposite said second set of contacts of said first flexible circuitry; and at least one opening accessory having an elongated base member adapted to the edge of a printed circuit board like member to be connected, said opening accessory including first and second cam means being positioned along the elongated length of said base member, said first cam means being positioned at one end of said base member and said second cam member being positioned at the other end of said base member, each cam means having camming surfaces to contact the cam bearing portions of a biasing member to open said biasing member by moving each arm of the biasing member away from the other arm of the biasing member.

DESCRIPTION OF THE DRAWING

FIG. 6 also illustrates the penetration of a portion of the biasing member by the cam means to prevent rotation of the biasing member.

DESCRIPTION OF THE PREFERRED EMBODIMENTS

Figure 1:
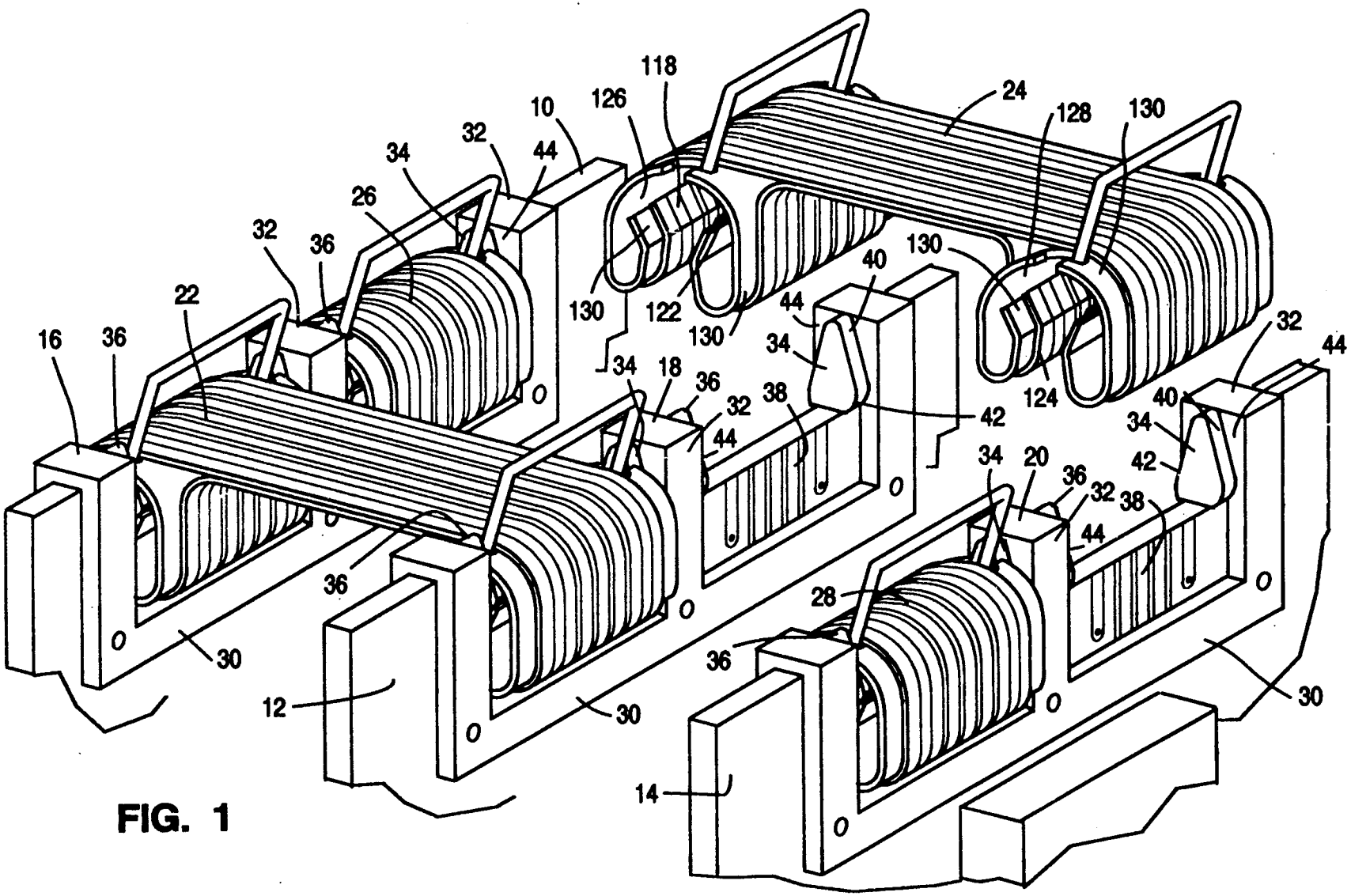
FIG. 1 is an exploded perspective view of three printed circuit board like members with opening accessories, connectors and bridge connectors of the invention connected thereto. One of the bridge connectors is not mated and is shown spaced from corresponding opening accessories.

With continued reference to the drawing, FIG. 1 illustrates printed circuit board like members 10, 12 and 14 having multiple opening accessories 16, 18 and 20 secured thereto. Bridge connectors 22 and 24 are also shown wherein bridge connector 22 is mated with printed circuit board like members 10 and 12. Bridge connector 24 is shown de-mated from printed circuit board like members 12 and 14. Connectors 26 and 28 are mated with printed circuit board like members 10 and 14, respectively.

Multiple opening accessories 16, 18 and 20 each accommodate two connectors. It is understood that an opening accessory may have one or more openings for one or more connectors, as desired. Each opening accessory 16, 18, 20 has a base member 30 which is secured to the edge of the respective printed circuit board like members 10, 12, 14. Each base member 30 is elongated and has opposite ends 32.

Opening accessories 16, 18 and 20 each include first and second cam means 34 and 36 connected to the base member 30. First cam means 34 is positioned at one end of the base member 30, and the second cam means 36 (which is primarily hidden in FIG. 1) is positioned at the opposite end 32 of the base member. Again, it is understood that the above description is with regards to an opening accessory for a single opening and that FIG. 1 illustrates multiple opening accessories having more than one set of camming surfaces, i.e., one set for each opening.

As seen in FIG. 1, the first and second cam means 34 and 36 are spaced from each other exposing portions 38 of printed circuit board like members 12 and 14.

Each cam means 34 and 36 has first and second camming surfaces 40 and 42, respectively, to bias open a connector upon mating and de-mating to a printed circuit board like member. Each opening accessory also has alignment means 44 connected to base member 30 to position end portions of a connector to be mated with a printed circuit board like member. The alignment means illustrated in FIG. 1 is an alignment surface. As will be discussed later in further detail, the alignment means may be integral with the cam means.

FIG. 1 illustrates bridge connectors 22 and 24 and connectors 26 and 28. Bridge connector 22 interconnects opposite sides of separate circuit board like members 10 and 12. Bridge connector 24 interconnects opposite sides of separate circuit board like members 12 and 14. Connector 26 connects opposite sides of the same circuit board like member 10. Connector 28 connects opposite sides of the same circuit board like member 14. The structure of bridge connectors 22 and 24 is better illustrated in FIG. 8. The structure of connectors 26 and 28 is further illustrated in FIG. 7. The connectors and bridge connectors operate as a system to interconnect any number of boards and allows for later expansion.

Figure 2:
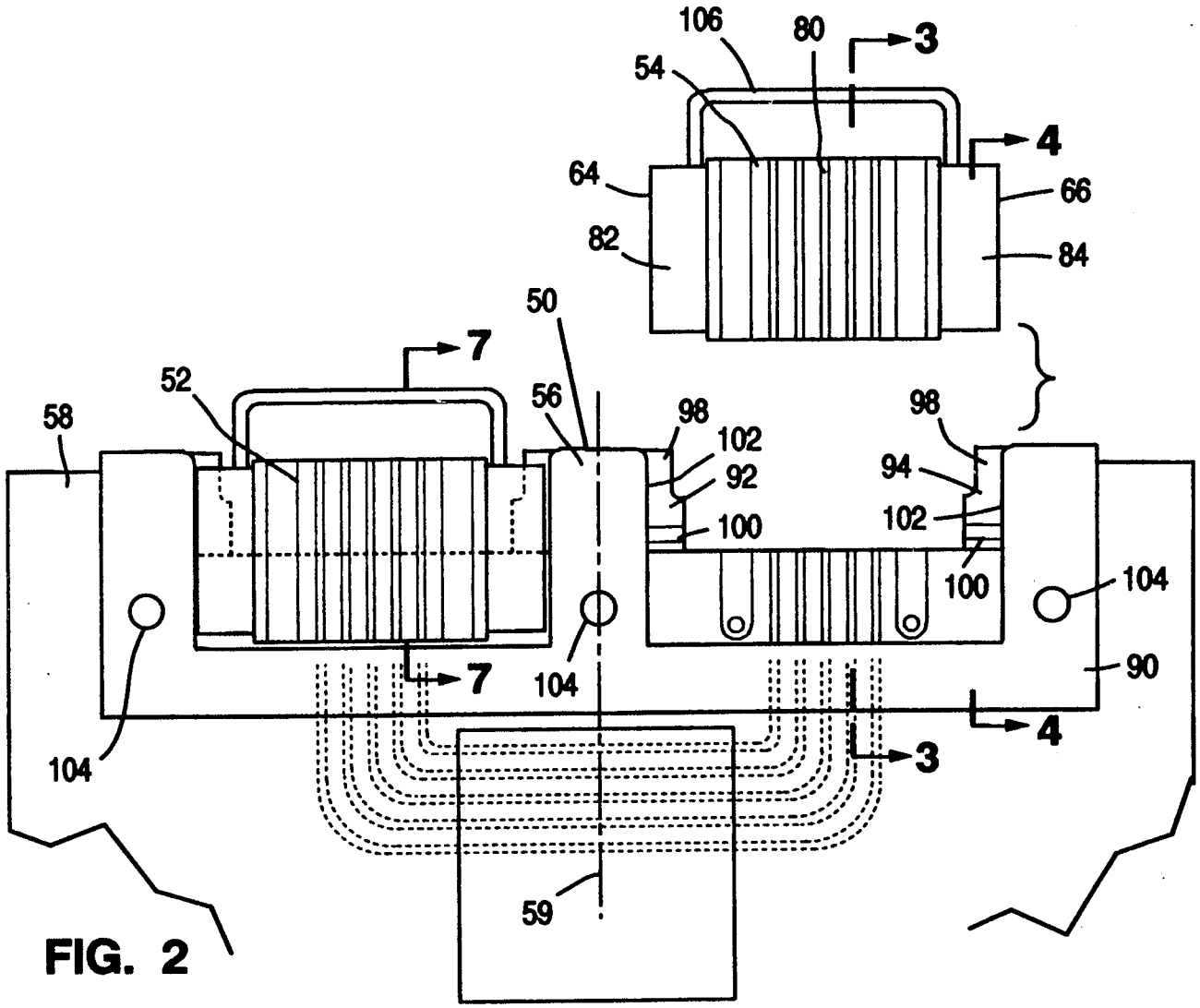
FIG. 2 is a partial frontal view of a printed circuit board like member having a multiple opening accessory attached thereto along with a pair of bridge connectors, one mated with the printed circuit board like member and one positioned above an opening accessory.
Figure 3:
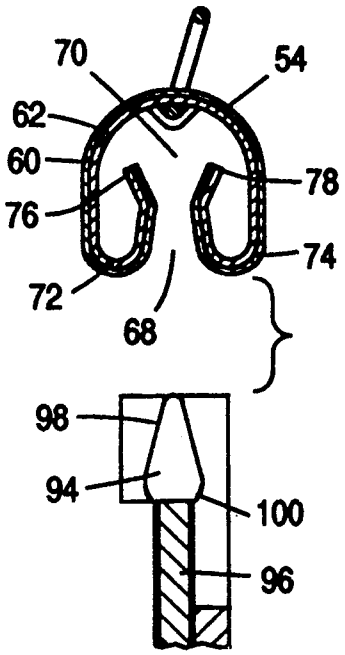
FIG. 3 is a partial cross-sectional view taken along section line 3—3 in FIG. 2 showing a bridge connector spaced above an opening accessory mounted to a printed circuit board like member.

FIG. 2 illustrates a connector assembly shown generally at 50 having connectors 52 and 54 along with opening accessory 56. Connector 52 is shown mated to printed circuit board like member 58. Connector 54 is shown positioned above opening accessory 56 much as connector 24 is shown positioned above opening accessories 18 and 20 in FIG. 1.

Chip package 11 has conductive leads (not shown) protruding at right angles from each side of the package. Each adjacent pair of leads comprises a differential pair on which electrical signals travel. Pairs to the left of center line 59 transmit a differential signal and those to the right of line 59 receive an electrical signal. These signals travel on etched metal traces 11 on the printed circuit board like member and electrically contact the corresponding circuit trace pair or conductive paths 80 in the flexible circuit of the connector. These signals then travel on these conductive paths 80 in the connector and contact electrically to another printed circuit board like member which has contact pads connected to the rainbow circuit pattern 15 but on another printed circuit board like member. This total circuit path from one printed circuit board like member to another, when done with this connector, can be done without plated through holes which are needed with other connector devices.

The operation of opening accessory 56, specifically the portion of opening accessory 56 positioned to the right of center line 59 shown in FIG. 2 corresponding to a single opening and connector 54, will now be described in further detail. It should be appreciated that the opening accessory of the invention is useful with any spring biased connector having flexible circuitry or the like wherein the connector requires opening upon mating to prevent damage to the circuitry. Although the opening accessory is shown attached to a printed circuit board like member 58, it is understood that other components, i.e., insertion members, having conductive traces thereon may be attached to the opening accessory of the invention.

The purpose of the opening accessory 56 is to protect the contacts on the flexible circuitry 60 from being damaged by the sharp edges of the printed circuit board like member 58. Opening accessory 56 is partially or entirely made from a polymeric material. Any material having desired mechanical and electrical properties would be appropriate for the opening accessory. Connector 54 includes biasing member 62 of spring-like material. Biasing member 62 is elongated having opposite ends 64 and 66 and a longitudinal opening 68 along the length thereof. Biasing member 62 is generally C-shaped having a center portion 70 and arm portions 72 and 74 having ends 76 and 78. Biasing member 62 can be made from any resilient material, such as beryllium copper, and may be partially severed along the length thereof, such as in the area of the ends 76 and 78, to provide compliance to contact surfaces, etc. It is within the scope of the invention for the biasing member to be two or more pieces joined together in the center portion of the biasing member. Flexible circuitry 60 has generally parallel-spaced electrical conductors 80. At least a portion of the flexible circuitry 60 is mounted about the biasing member 62 leaving cam bearing portions 82 and 84 adjacent the opposite ends 64 and 66 of the biasing member 62. For purpose of description, the cam bearing portions 82 and 84 are shown and described herein as being exposed portions of the biasing members. "Cam bearing surfaces" is defined herein to include the surface of the biasing members, coatings or platings thereon, extensions of the flexible circuitry dielectric material, extended electrically conductive surfaces of the flexible circuitry or any other surface which provides desired mechanical and electrical properties.

As seen in FIG. 2, the edge of printed circuit board like member 58 has been cut away for the mounting of opening accessory 56, such that opening accessory 56 is generally flush with the edge of printed circuit board like member 58. Without reference to an additional figure, it is understood that the opening accessory and all its components can be formed with the printed circuit board like member. Opening accessory 56 includes a base member 90 secured to the edge of the printed circuit board like member 58 and further includes first and second cam means 92 and 94. First cam means 92 is positioned at one end of the base member as defined by center line 59, and second cam means 94 is positioned at the other end of the base member exposing portion 96 of printed circuit board like member 58 between first and second cam means 92 and 94. Each cam means 92 and 94 has first and second camming surfaces 98 and 100, respectively. Camming surfaces 98 and 100 of cam means 94 can be more clearly seen in FIGS. 3–7. It is within the scope of the invention to make the base member integral with the printed circuit board like member, i.e., the base member is the printed circuit board like member. It is understood that the concept that the base member is secured to the edge of a printed circuit board like member encompasses the base member being integral with the printed circuit board like member. It is also within the scope of the invention to make the cam means and the alignment means discussed below integral with the printed circuit board like member. The alignment means shown in FIG. 1 comprises ends 64 and 66 and corresponds to alignment means 102 in FIG. 2. The fastener 104 aligns surfaces (102) to the printed circuit board like member traces. Surfaces 64, 66 are a set distance from the flexible circuit contact pads in the connector. When 64, 66 and 102 align, the connector contact pads and printed circuit board like member pads are aligned. Opening accessory 56 further includes alignment means 102 connected to base member 90 to position the ends 76, 78 and thus the connector to be mated to printed circuit board like member 58. The alignment means as shown is an alignment surface. Cam means 92 and 94 have entry/exit cam surfaces thereon which have been referred to as first and second camming surfaces 98 and 100.

Figure 4:
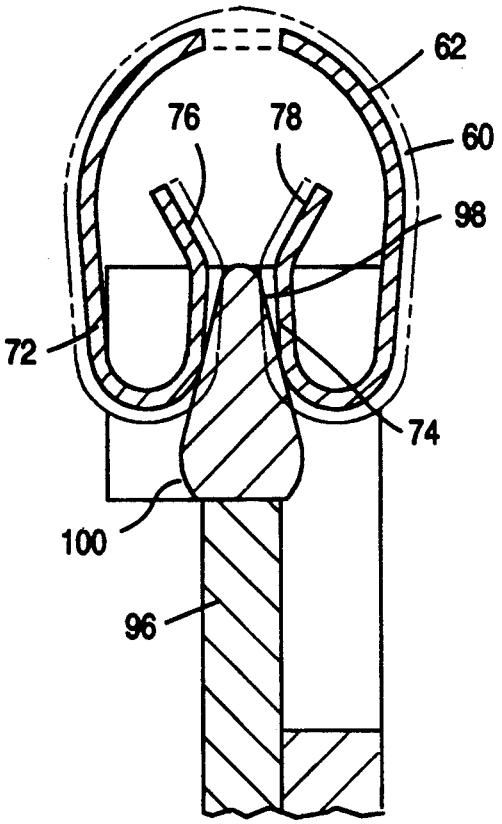
FIG. 4 is a partial cross-sectional view taken along section line 4—4 in FIG. 2 showing the biasing member of a bridge connector contacting a cam means of an opening accessory.
Figure 5:
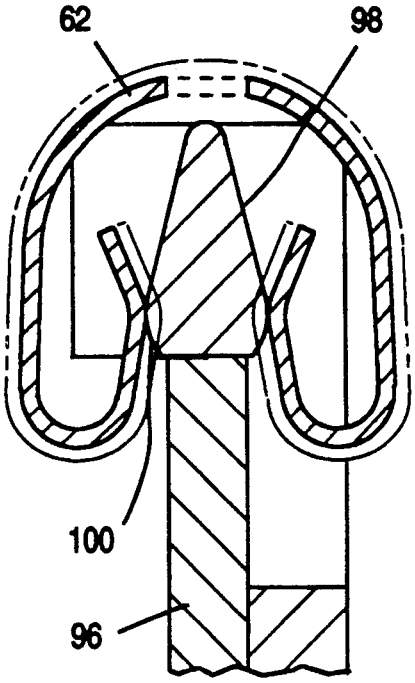
FIG. 5 is a partial cross-sectional view similar to FIG. 4 wherein the ends of the arm portions of the biasing member have been spread by the first camming surface of the cam means.
Figure 6:
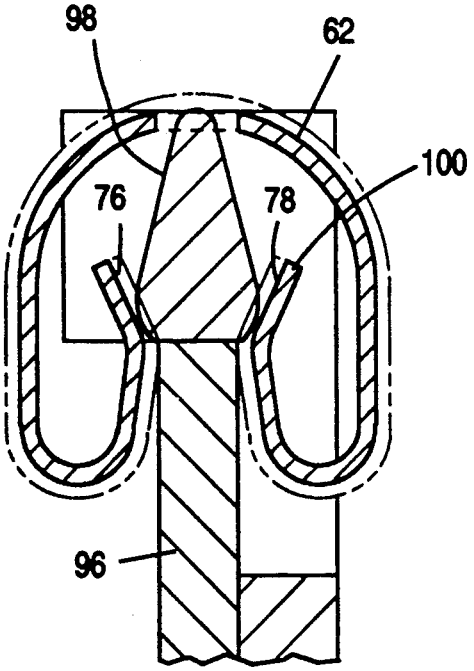
FIG. 6 is a partial cross-sectional view similar to FIGS. 4 and 5 showing the ends of the arm portions of the biasing member in contact with the second camming surface of the cam means.
Figure 7:
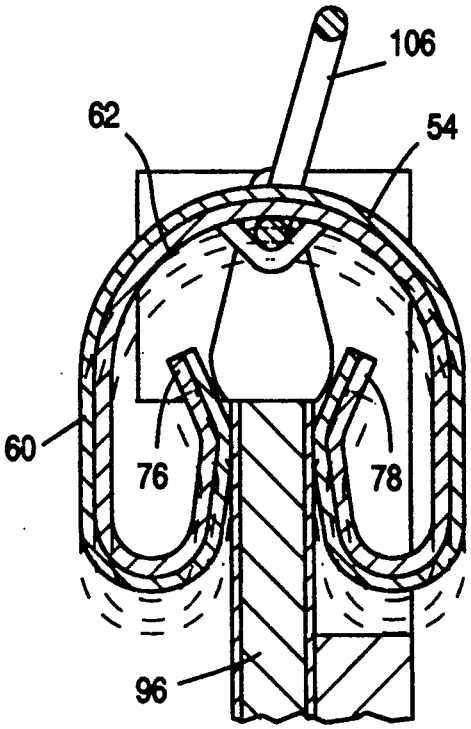
FIG. 7 is a partial cross-sectional view taken along section line 7—7 in FIG. 2 showing the portion of the connector having both the biasing member and the flexible circuitry completely mated with the printed circuit board like member having an opening accessory.

With reference to FIG. 4, as the biasing member 62 with flexible circuitry 60 positioned thereon is dropped down, the cam bearing portions 82 and 84 of the biasing member contact first camming surfaces 98 (the entry camming surfaces). Note that FIGS. 4-6 are cross-sectional views through cam bearing portion 84 seen in FIG. 2. As the biasing member is pushed further down (see FIG. 5), it is spread apart further by camming surfaces 98. This spreads the connector contact surfaces apart. As the biasing member 62 is pushed still further down it slides along second camming surface 100 which may include a surface portion that is generally vertical (not shown). This causes the flexible circuitry 60 to be lifted away from and over the sharp edges of the printed circuit board like member 58. The lowermost portion of camming surfaces 100 (as seen in FIG. 6) are tapered toward the printed circuit board like member to provide exit surfaces. FIG. 6 also illustrates the anti-rotation feature of the invention wherein camming surface 98 penetrates biasing member 62 at the ends 64, 66 upon mating of the connector. FIG. 7 is a cross-section through a portion of the connector having flexible circuitry 60 positioned thereon. The flexible circuitry 60, seen in FIG. 7, positioned within center portion 70 on ends 76 and 78 will make contact and slide over complementary contact portions of printed circuit board like member 58. Further movement, as shown in phantom line in FIG. 7, provides some wiping action between the electrical contacts. Wiping action occurs as the connector slides from position 79 to 81 where electrical and physical contacts (FIG. 7) are made. Both the location and length of the wiping zone are controllable.

Connector 54 can be de-mated from the printed circuit board like member 58 in a similar fashion. The angle of the exit surfaces-second camming surfaces 100 will spread apart the cam bearing portions 82 and 84 of ends 76 and 78 of biasing member 62. The angle of the second camming surfaces 100 can be of such a value that biasing member 62 will tend to snap/click into place when the surface angles with respect to the vertical are great enough. An audible click and a mechanical snap action signal the user that the connector is properly seated. If the angle is smaller, then the biasing member will tend to slide more slowly into place and not snap or click into place.

Figure 9:
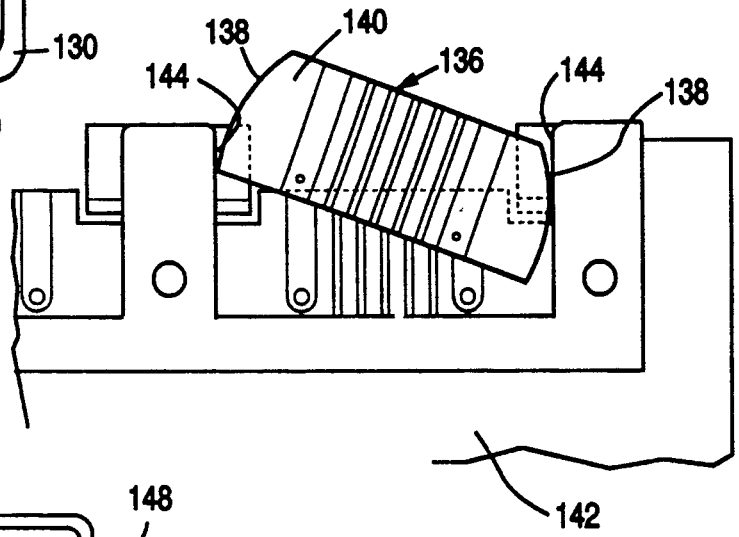
FIG. 9 is a partial frontal view of an alternate embodiment of the invention engaging an opening accessory wherein the connector is aligned and rotated into mating position to prevent binding of the connector.
Figure 10:
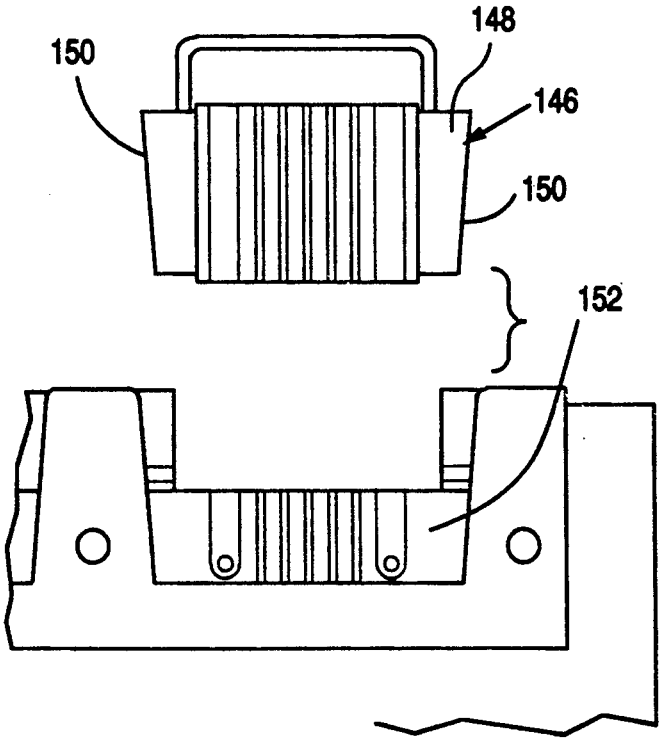
FIG. 10 is a partial frontal view similar to FIG. 9 of yet another alternate embodiment of a connector and opening accessory having tapered surfaces to align and mate the connector.

Alignment is made by first placing the opening accessory on printed circuit board like member 58 with alignment means 102 carefully positioned with respect to the contacts on the printed circuit board like member. An alignment feature on the printed circuit board like member such as a hole or a slot (not shown) is placed in the printed circuit board like member accurately with respect to the printed circuit board like member contacts. The opening accessory has a pin, rivet or other suitable fastener 104, either integral with or as a separate feature, which is fitted into the printed circuit board like member slot, hole or other alignment feature. Soldering can also fasten the opening accessory to the printed circuit board like member, and surface tension during heating of solder will align the opening accessory onto the printed circuit board like member contact pads. As seen in FIG. 2, first and second cam means may be partially laterally cut away to align a connector upon mating. In this regard the alignment means is integral with the first and second cam means. When the biasing member is dropped onto the opening accessory, it slides between the surfaces of alignment means 102. FIGS. 9 and 10 illustrate optional alignment schemes and will be discussed in detail later.

FIG. 7 is a cross-sectional view taken along section line 7—7 in FIG. 2 of a connector to clearly illustrate that the flexible circuitry 60 is in contact with printed circuit board like member 58. FIG. 7 also illustrates bale 106 which can assist in de-mating and removal of connector 54 of printed circuit board like member 58. It is understood that other extraction devices functionally equivalent to bale 106 are considered to be included within the scope of the invention.

Figure 8:
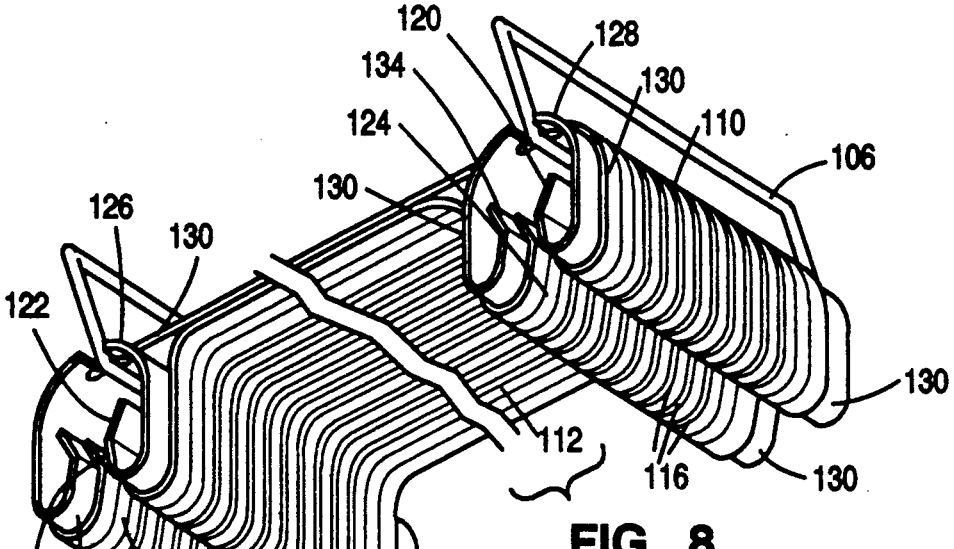
FIG. 8 is a perspective view of the underside of a bridge connector shown in FIG. 1.

FIG. 7 also illustrates that the connector 54 has flexible circuitry 60 which interconnects opposing sides of printed circuit board like member 58. FIG. 8 illustrates a bridge connector wherein flexible circuitry interconnects opposite sides of two printed circuit board like members. For purposes of the invention "flexible circuitry" is defined to include circuit paths which include but not be limited to round wire, flat cable, etched and additive flexible circuitry, conductive inks and polymers. All of the above circuit paths can be configured to control electrical characteristics, e.g., co-planar, co-planar with ground plane, microstrip, grounded microstrip, stripline and other transmission line structures. It is understood that the electrical conductors illustrated terminate in at least one set of electrical contacts wherein the set of contacts is positioned on at least one side of the opening in a connector, i.e., the connectors of the invention can interconnect conductors on one or both sides of a printed circuit board like member.

FIG. 8 shows the underside of a bridge connector, such as bridge connector 24, having first and second flexible circuitry 110 and 112, respectively. First and second flexible circuitry 110 and 112 each have sets of generally parallel electrical spaced conductors 114 and 116, respectively. Electrical conductors 114 of flexible circuitry 110 terminate in first and second sets of electrical contacts 118 and 120. Electrical conductors 116 of second flexible circuitry 112 terminate in first and second sets of electrical contacts 122 and 124. First and second flexible circuitry 110 and 112 are positioned about first and second biasing members 126 and 128 leaving cam bearing portions 130 adjacent the opposite ends of each biasing member 126 and 128. The first set of contacts 118 of the first flexible circuitry 110 are positioned within the center portion of the first biasing member 126, and the second set of contacts 120 of the first flexible circuitry 110 are positioned within the center portion of the second biasing member 128. The first set of electrical contacts 122 of the second flexible circuitry 112 are positioned within the center portion of the first biasing member 126 on an arm portion 132 opposite the first set of contacts 118 of the first flexible circuitry 110, and the second set of contacts 124 of the second flexible circuitry 112 are positioned in the center portion of the second biasing member 128 on an arm portion 134 opposite the second set of contacts 120 of the first flexible circuitry 110.

FIG. 9 illustrates an alternate embodiment of connector shown generally at 136 wherein the ends 138 of the biasing member 140 are rounded. The center of radius of the rounded edges 138 can be the center of radius of the biasing member 140. The biasing member 140 is pushed into the opening accessory 142. Either end 138 can be pushed into the opening accessory 142 initially, and binding within the opening accessory 142 having alignment surfaces 144 will not occur.

FIG. 10 illustrates yet another embodiment of connector shown generally at 146 wherein the biasing member 148 has ends 150 at an angle with respect to the vertical. When one end 150 of the biasing member 148 is pushed into the opening accessory 152 it will tend to make the biasing member 148 self-centering and will act against binding. It can be seen that the embodiments of FIGS. 9 and 10 provide alignment means to control the movement of the biasing member and flexible circuitry along a path other than perpendicular to the base member.

From the foregoing detailed description, it is evident that there are a number of changes, adaptations and modifications of the present invention which come within the province of those skill in the art. However, it is intended that all such variations not departing from the spirit of the invention will be considered as being within the scope thereof and as being limited solely by the appended claims.

What is claimed is:

1. An opening accessory for a connector comprising:

a base member adapted to be secured to the edge of a printed circuit board like member, said base member being elongated and having opposite ends;

at least one set of first and second cam means connected to said base member, said first cam means positioned at one end of said base member and said second cam means positioned at the other end of said base member exposing portions of a printed circuit board like member between said first and second cam means, each said cam means having first and second camming surfaces to spread open a connector upon mating and de-mating to a printed circuit board like member; and at least one alignment means connected to said base member to position end portions of a connector to be mated to a printed circuit board like member.

2. An opening accessory as in claim 1 wherein said first camming surfaces contact end portions of a connector to be mated to a printed circuit board like member to open such a connector and said second camming surfaces contact the end portions of a connector to be mated to control the closing of a connector onto a printed circuit board like member and to signal that the connector is properly seated.

3. An opening accessory as in claim 1 wherein said base member includes more than one set of camming surfaces and alignment means to accommodate more than one connector to be mated along the edge of a printed circuit board like member.

4. An opening accessory as in claim 1 further including a printed circuit board like member wherein said base member is the printed circuit board like member.

5. An opening accessory as in claim 4 wherein said cam means is integral with said printed circuit board like member.

6. An opening accessory as in claim 4 wherein said alignment means is integral with said printed circuit board like member.

7. A connector assembly comprising:

a connector having a biasing member, said biasing member being elongated with opposite ends having a longitudinal opening along the length thereof, said biasing member being generally C-shaped and having a center portion and arm portions having ends;

flexible circuitry having generally parallel-spaced electrical conductors, at least a portion of said flexible circuitry mounted about said biasing member leaving cam bearing portions adjacent the opposite ends of said biasing member, said electrical conductors terminating in at least one set of electrical contacts, said set of contacts being positioned on at least one side of said opening; and an opening accessory having a base member, said base member being elongated and adapted to be connected to the edge of a printed circuit board like member to be mated, said opening accessory including first and second cam means positioned at opposite ends of said base member, each said cam means having first and second camming surfaces, said opening accessory including alignment means to position the cam bearing portions of said biasing member.

8. A connector assembly as in claim 7 wherein the opposite ends of said biasing member and the alignment means of said opening accessory control movement of said biasing member and flexible circuitry toward and away from a printed circuit board like member to be connected along a path generally perpendicular to said base member.

9. A connecter assembly as in claim 7 wherein the opposite ends of said biasing member and said alignment means control the movement of said biasing member and flexible circuitry along a path other than perpendicular to said base member.

10. A connector assembly as in claim 7 wherein said first camming surfaces of the opening accessory contact end portions of a connector to be mated to a printed circuit board like member to open such a connector and said second camming surfaces contact the end portions of a connector to be mated to control the closing of a connector onto a printed circuit board like member.

11. An opening accessory as in claim 7 further including a printed circuit board like member wherein said base member is the printed circuit board like member.

12. An opening accessory as in claim 11 wherein said cam means is integral with said printed circuit board like member.

13. An opening accessory as in claim 11 wherein said alignment means is integral with said printed circuit board like member.

14. A connecter assembly comprising:

first and second connectors having first and second biasing members, respectively, said biasing members each being elongated and having opposite ends and a longitudinal opening along the length thereof, said biasing members being generally C-shaped and each having a center portion and arm portions having ends;

first and second flexible circuitry, each circuitry having sets of generally parallel-spaced electrical conductors, said electrical conductors terminating in first and second sets of electrical contacts, respectively, said first flexible circuitry positioned about said first and second biasing members leaving cam bearing portions adjacent the opposite ends of each said biasing member, the first set of contacts of said first flexible circuitry being positioned within the center portion of said first biasing member and the second set of contacts of said first flexible circuitry being positioned within the opening of said second biasing member;

said first set of electrical contacts of said second flexible circuitry being positioned within the center portion of said first biasing member on an arm portion opposite said first set of contacts of said first flexible circuitry and said second set of contacts of said second flexible circuitry being positioned in the center portion of said second biasing member on an arm portion opposite said second set of contacts of said first flexible circuitry; and at least one opening accessory having an elongated base member adapted to the edge of a printed circuit board like member to be connected, said opening accessory including first and second cam means being positioned along the elongated length of said base member, said first cam means being positioned at one end of said base member and said second cam member being positioned at the other end of said base member, each cam means having camming surfaces to contact the cam bearing portions of a biasing member to open said biasing member by moving each arm of the biasing member away from the other arm of the biasing member.

15. A connecter assembly as in claim 14 wherein the opposite ends of said biasing member and said alignment means control the movement of said biasing member and flexible circuitry along a path other than perpendicular to said base member.

16. A connector assembly as in claim 14 wherein said first camming surfaces of the opening accessory contact end portions of a connector to be mated to a printed circuit board like member to open such a connector and said second camming surfaces contact the end portions of a connector to be mated to control the closing of a connector onto a printed circuit board like member.

17. An opening accessory as in claim 14 further including a printed circuit board like member wherein said base member is the printed circuit board like member.

18. An opening accessory as in claim 15 wherein said cam means is integral with said printed circuit board like member.

19. An opening accessory as in claim 14 wherein said alignment means is integral with said printed circuit board like member.

* * * * *

UNITED STATES PATENT AND TRADEMARK OFFICE

CERTIFICATE OF CORRECTION

PATENT NO. : 5,195,897

DATED : March 23, 1993

INVENTOR(S) : Harold B. Kent, et al.

It is certified that error appears in the above-identified patent and that said Letters Patent is hereby corrected as shown below:

Column 2, line 26, delete "connecter" and insert --connector-- therefor;

Column 4, line 36, delete "o" and insert --to-- therefor;

Column 9, line 36 and 57, delete "connecter" and insert --connector-- therefor;

Column 10, line 40, delete "connecter" and insert --connector-- therefor.

Signed and Sealed this

Eighth Day of February, 1994

Bruce Lehman

*Attest:*

BRUCE LEHMAN

*Attesting Officer*

*Commissioner of Patents and Trademarks*